US008516934B2

(12) United States Patent
Shevela et al.

(10) Patent No.: US 8,516,934 B2
(45) Date of Patent: Aug. 27, 2013

(54) FUEL RAIL CLIP TOOL

(75) Inventors: Michael Shevela, Harrison Township, MI (US); Richard Martin, Clinton Township, MI (US); Robert Meitzler, Brighton, MI (US)

(73) Assignee: Service Solutions U.S. LLC, Warren, MI (US)

( * ) Notice: Subject to any disclaimer, the term of this patent is extended or adjusted under 35 U.S.C. 154(b) by 843 days.

(21) Appl. No.: 12/489,983

(22) Filed: Jun. 23, 2009

(65) Prior Publication Data

US 2010/0319500 A1 Dec. 23, 2010

(51) Int. Cl.
*B25B 7/02* (2006.01)

(52) U.S. Cl.
USPC ..... 81/486; 81/426

(58) Field of Classification Search
USPC ..... 81/486, 424.5, 426, 426.5, 9.3, 485, 81/418; 29/428
See application file for complete search history.

(56) References Cited

U.S. PATENT DOCUMENTS

| | | | | | |
|---|---|---|---|---|---|
| 483,695 | A | * | 10/1892 | Ray | 227/31 |
| 1,929,163 | A | * | 10/1933 | Diskin et al. | 254/248 |
| 2,700,910 | A | * | 2/1955 | Van Niel | 29/268 |
| 4,075,749 | A | * | 2/1978 | Hubeny | 29/268 |
| 4,416,045 | A | * | 11/1983 | Staten | 29/229 |
| 4,617,710 | A | * | 10/1986 | Kotnik | 29/268 |
| 5,022,292 | A | * | 6/1991 | Hammer et al. | 81/426 |
| 2005/0261784 | A1 | * | 11/2005 | Erb | 623/65 |

* cited by examiner

*Primary Examiner* — Monica Carter
*Assistant Examiner* — Melanie Alexander
(74) *Attorney, Agent, or Firm* — Baker Hostetler LLP

(57) ABSTRACT

A clip installing tool and method for installing the clip are provided. The clip includes a clip holding portion and a leveraging portion, each having a handle at an end. The clip holding portion includes a receiving portion to hold the clip therein. When a force is applied to the clip holding and leveraging portions, the clip is forced around a connector portion of a fuel in order to hold the connector portion with a fuel injector.

16 Claims, 3 Drawing Sheets

FUEL RAIL CLIP TOOL

FIELD OF THE INVENTION

The present invention relates generally to a tool to install a fuel rail clip. More particularly, the present invention relates to a tool to install a fuel rail clip that holds a high pressure injectors in place.

BACKGROUND OF THE INVENTION

A fuel rail in a vehicle includes fuel injectors that inject fuel into a vehicle's engine. Often these fuel injectors are high pressure fuel injectors that can be electronic controlled. Because they are electronically controlled, the fuel injectors can inject the exact amount of fuel needed into the engine at the most optimum time for maximum engine efficiency. The high pressure injectors can be coupled to the fuel rail via a clip. Accordingly, it is desirable to provide a tool that can place the clip onto the fuel rail to secure the fuel injector.

SUMMARY OF THE INVENTION

The foregoing needs are met, to a great extent, by the present invention, wherein in one aspect an apparatus is provided that in some embodiments include a clip tool having a clip holder portion.

In accordance with one embodiment of the present invention, a clip installing tool is provided, which can comprise a clip holding portion having a receiving portion at a first end that receives a clip, a leveraging portion having a shim at a first end and a curved middle portion, a pivot pin that couples the clip holding and leveraging portions, and a handle at a second end of the clip holding and the leveraging portions, wherein the receiving portion includes a first step, a magnet and flats to keep the clip in place during installation.

In accordance with another embodiment of the present invention, a clip installing tool is provided, which can comprise a means for holding configured to have a means for receiving at a first end that receives a clip, a means for leveraging configured to have a shim at a first end and a curved middle portion, a means for pivoting configured to couple the means for holding and means for leveraging, and a means for gripping at a second end of the means for holding and the means for leveraging, wherein the means for receiving includes a first step, a magnet and flats to keep the clip in place during installation.

In accordance with yet another embodiment of the present invention, is a method of installing a clip on a fuel rail, which can comprise placing the clip to be installed in a receiving portion of a clip installation tool, aligning the clip within the receiving portion using a step, a window and flats of the receiving portion, placing the receiving portion and a leveraging portion on opposite sides of a connector of the fuel rail, aligning a hole in the clip with the window, and applying a force of a sufficient strength that forces the clip around the connector and so that the hole in the clip receives a connector protrusion and an injector protrusion.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
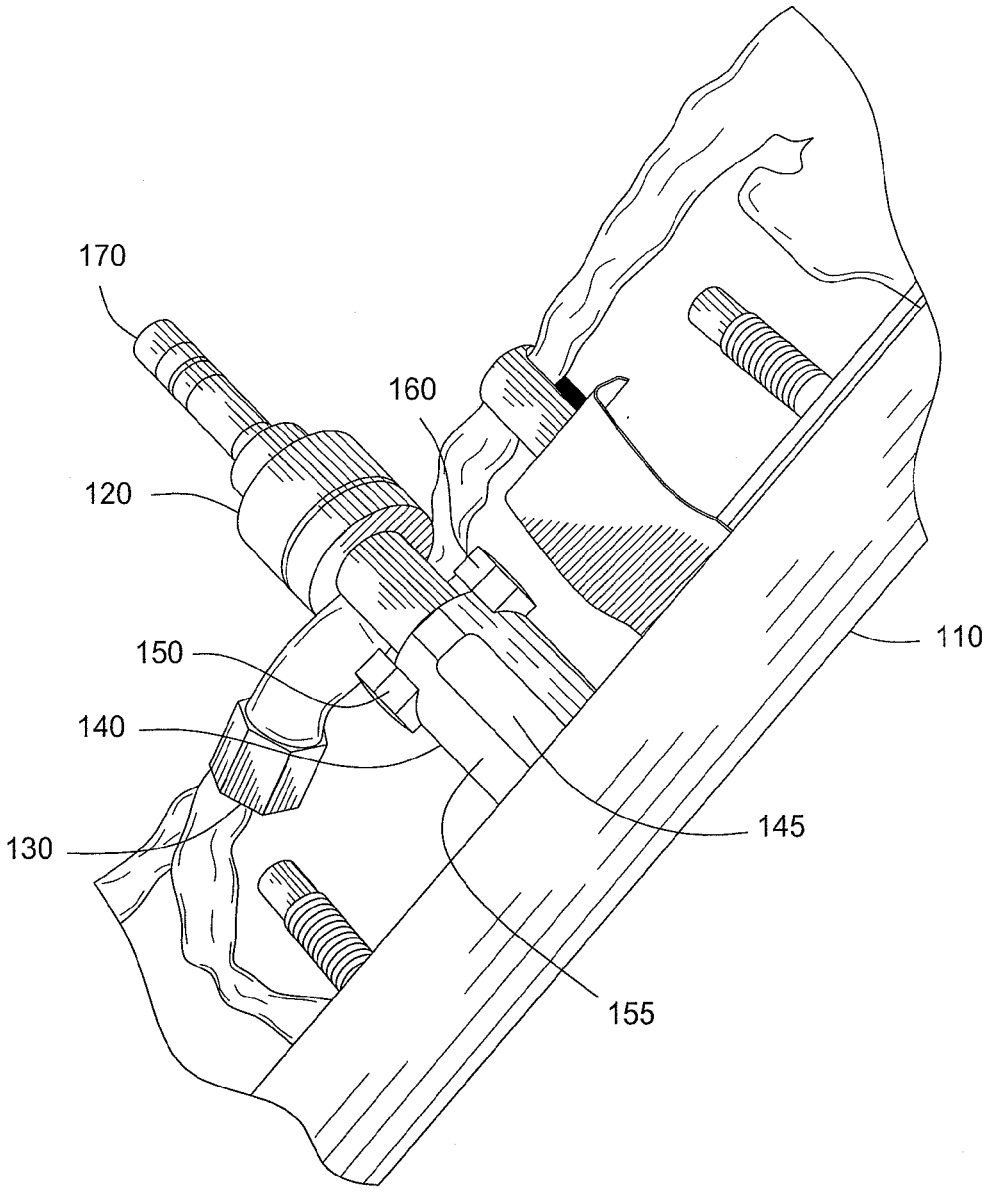
FIG. 1 illustrates an example of a fuel rail to which a clip will be installed.

The invention will now be described with reference to the drawing figures, in which like reference numerals refer to like parts throughout. An embodiment in accordance with the present invention provides a clip tool and a method to install a clip on a fuel rail. The clip couples a fuel injector to the fuel rail.

FIG. 1 illustrates an example of a fuel rail 100 to which a clip will be installed. The fuel rail 100 includes a fuel shaft 110, a fuel injector 120, a control line 130 and an injector connector 140. The fuel shaft 110 is constructed and designed to provide fuel to the fuel rail and ultimately to the fuel injector 120. The fuel is used to power an engine, such as an engine in a vehicle, to which the fuel rail is attached.

A first end of the injector connector 140 is connected to the fuel shaft 110 and a second end is connected to a first end of the fuel injector 120. The injector connector 140 can have generally many sides which includes a flat portion 145 and a semi-rounded portion 155. Also at the second end of the injector connector 140 are connector protrusions 150 that are identical or similar to injector protrusions 160 that are located at the first end of the fuel injector 120. The connector protrusions 150 and the injector protrusions 160 are complementary to each other. For example, there could be one, two, three, four or more connector protrusions 150 and there would be the same number of injector protrusions 160. A clip 200 (FIG. 2) is constructed and designed to couple the connector protrusions 150 and the injector protrusions 160 together and thus, coupling the injector connector 140 and the fuel injector 120 together.

Also shown in FIG. 1 is the control line 130, which is designed to electronically control the fuel injector 120. The control line 130 can be coupled to the fuel injector 120 at its first end. The control line 130 controls the amount of fuel the fuel injector 120 will inject into the engine. The fuel injector 120 injects fuel at its second end 170.

Figure 2:
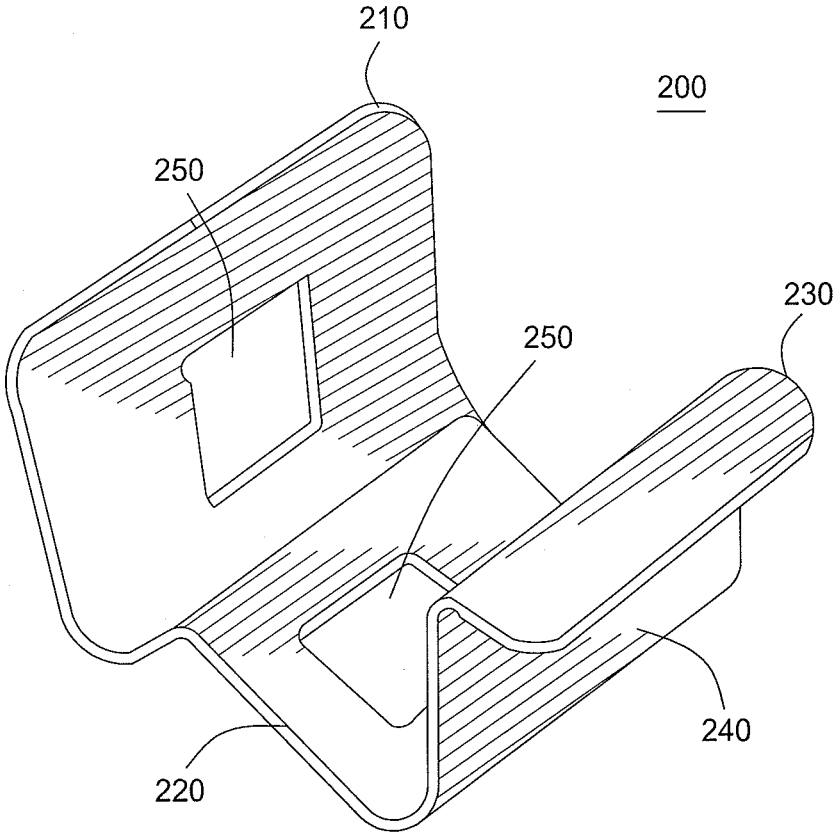
FIG. 2 illustrates an exemplary clip that can be installed with the clip tool.
Figure 3:
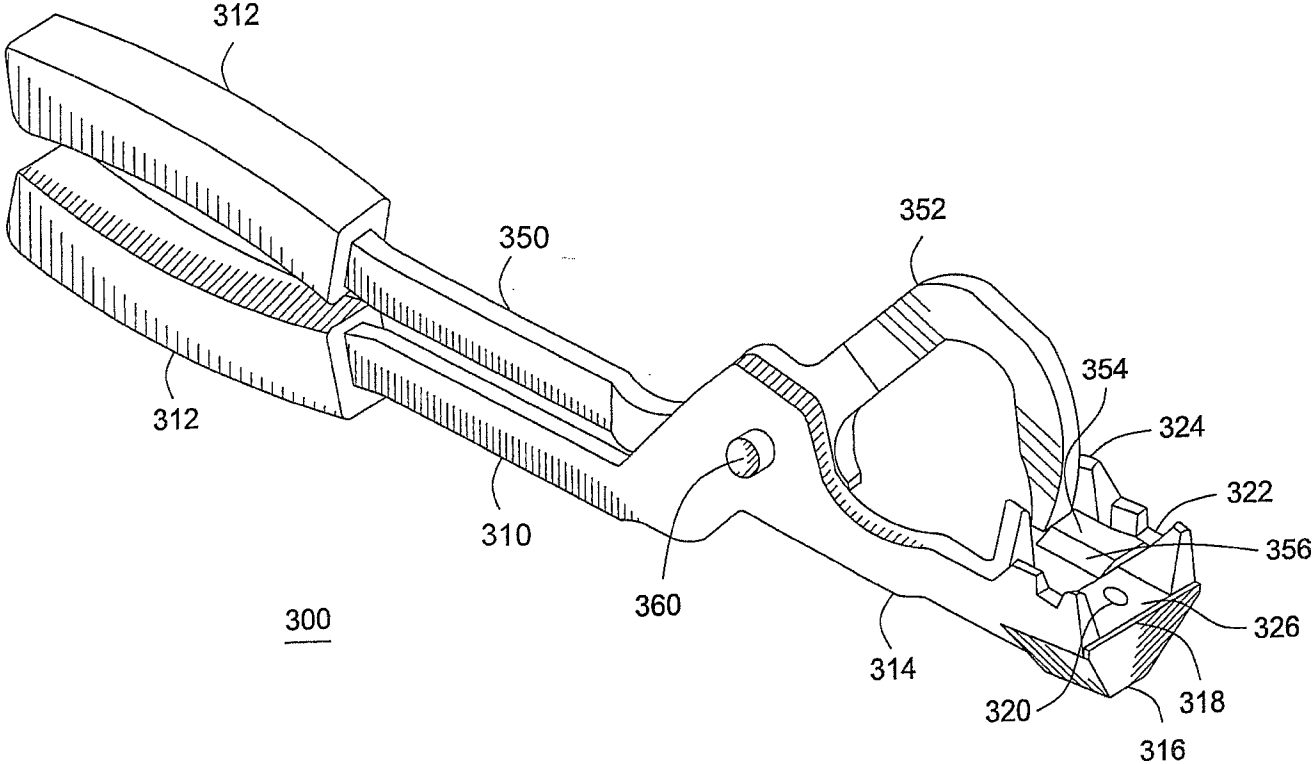
FIG. 3 illustrates the clip tool according to an embodiment of the invention.

FIG. 2 illustrates an exemplary clip that can be installed with the clip tool 300 (FIG. 3). The clip includes a first portion 210, a second or middle portion 220 and a third portion 230.

The clip 200 can be made from any material, such as steel, aluminum, tin or another other material. The third portion 230 has an angled portion 240 at an end not connected to the middle portion 220. The first, second and third portions are designed to friction fit around the injector connector 140. However, it is difficult to install the clip as the first and third portions are designed to fit around the injector connector 140 and sufficient force is required to move the first and third portions around the injector connector's semi-rounded portion during installation. In other words, force is needed to cause the first and third portions around the injector connector's semi-rounded portions or enough to spread them apart when pushed around an outer diameter of the injector connector 140. This causes the first and third portions to be in a temporary expanded position. Once the first and third portions are pushed pass on both sides of the injector connector, they can return to their normal state. In this normal state, the first, second and third portions are friction fit around the injector connector 140.

The first, second and third portions include a hole 250 to receive the connector protrusions 150 and the injector protrusions 160. The holes 250 are constructed and designed to keep the connector protrusions 150 and the injector protrusions 160 coupled together so that they can't separate from each other and to prevent rotational movement with respect to each other. The separation and rotational movement are caused when the fuel injector 120 is in use.

FIG. 3 illustrates the clip tool 300 according to an embodiment of the invention. The clip tool 300 includes a clip holding portion 310 and a leveraging portion 350. The clip holding portion 310 and the leveraging portion 350 can be made of steel, aluminum, tin and other metals. However, the holding and the leveraging portions 310, 350 can be made of the same or different materials. The clip holding portion 310 and the leveraging portion 350 are coupled together by a pivot pin 360, which provides a pivot point for the clip holding portion 310 and the leveraging portion 350 to rotate with respect to each other.

At a first end of the clip holding portion 310 and the leveraging portion 350 is a handle 312. The handle 312 can include a soft cover made from a suitable material, such as a thermoplastic material. The handle 312 is constructed and designed to mate with a hand of a user of the clip tool 300. The handle 312 may be designed to be straight, may be curved or may be in any design that may be comfortable to a human hand.

A middle portion 314 of the clip holding portion 310 is generally flat but can be curved as required for easy installation of the clip. At a second end of the clip holder portion 310 is a receiving portion 316 that includes a step 318, a magnet 320, windows 322 and flats 324. The step 318 is provided at an end of the receiving portion 316 to align and hold in place the clip 200 received within the receiving portion 316. The magnet 320 is received within a hole in the receiving portion 316 so that it is flushed with a receiving surface 326 of the receiving portion 316. The magnet 320 helps to secure the clip 200 in place during installation.

The flats 324 generally protrude from the receiving surface 326 and are constructed and designed to receive and hold the clip 200 in place during installation. The flats 324 are designed to have close tolerances for proper alignment between the clip 200 and the fuel rail 110. The flats 324 can also be designed allow the clip to expand but prevent the clip from expanding too far during installation. The flats 324 may have different portions that have different angles and heights in relation to each other and the receiving surface. The flats 324 can also be designed so that they taper, for example, being wider at the bottom in relation to the top or vice versa. Additionally, some of the flats 324 can also angle in towards a center of the receiving portion 316 so that it can mate with the clip 200 and along with the step 318 prevent lateral movement of the clip during installation.

Windows 322 are provided to allow viewing of the placement of the clip 200 during installation in order to have proper placement of the clip with the connector portion. The receiving portion 316 can be designed accommodate the different parts of the clip 200 and other types of clips of varying sizes and shapes.

The leverage portion's middle portion has a curved portion 352 that is constructed and designed to provide clearance with the fuel rail during installation. The curve portion 352 starts at the pivot pin 360 and ends where the curve portion connects to a shim 354. The curve portion may generally look like a hook but can have any angle or curvature needed in order for the tool to work properly. The shim 354 also is designed to have a clearance of the injector connector and steps 356 in order to mate with the injector connector. The steps 356 are designed to mate with the semi-rounded portions on the injector connector while the remaining part of the shim 354 is flat to mate with the flat portion of the injector connector. The steps 356 help to keep the shim 354 in proper placement for better leverage while the tool is in use.

In operation, the clip 200 is placed in the receiving surface 326 of the clip holder portion 310. The clip 200 can be aligned with the step 318 and flats 324. The magnet 320 also assists to hold the clip 200 in place during installation. The tool 300 is positioned at the fuel rail 100 for the clip installation.

The clip 200 can be aligned with the injector connector 140 and force can be applied on the handles 312 so that the clip preliminarily mates with one portion of the injector connector 140 while the shim 354 mates with the opposite side of the injector connector 140. With the assistant of the windows 322, the user can align the clip's holes 250 with the connector protrusions 150 and the injector protrusions 160. Once the holes 250 are properly aligned and the shim mates with the injector connector 140, force can be applied to handles 312 so that the clip holder portion 310 forces the clip around the injector connector 140 and the holes 250 receive the connector protrusions 150 and the injector protrusions 160. With the clip installed on the injector connector 140, the injector connector 140 and the fuel injector 120 are fixably coupled together.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents maybe resorted to, falling within the scope of the invention.

What is claimed is:

1. A clip installing tool, comprising:

a clip holding portion having a receiving portion at a first end that receives a clip;

a leveraging portion having a curved portion having a first end and a shim that extends transversely from the first end of the curved portion at a first end of the leveraging portion;

a pivot pin that couples the clip holding and leveraging portions; and a handle at a second end of the clip holding and the leveraging portions opposite the first end of the clip holding and the leveraging portions, wherein the receiving portion includes a first step, first and second windows above a receiving surface that enable viewing of placement of the clip, and a magnet and flats configured to keep the clip in place during installation.

2. The clip installing tool of claim 1, wherein at least one of the first and second windows is configured to be aligned with a hole in the clip.

3. The clip installing tool of claim 1, wherein the shim includes a second step configured to mate with a connector, and the curved portion is configured to clear a portion of a fuel rail.

4. The clip installing tool of claim 1, wherein the flats are in close tolerance with the clip for proper alignment of the clip with a connector of a fuel rail.

5. The clip installing tool of claim 1, wherein the magnet is flush with the receiving surface so that the clip is flatly received within the receiving portion.

6. The clip installing tool of claim 1, wherein the handle is curved and includes an elastomeric material.

7. The clip installing tool of claim 1, wherein the flats are configured to allow the clip to expand during installation.

8. A clip installing tool, comprising:

means for holding configured to have a means for receiving at a first end that receives a clip;

means for leveraging configured to have a curved portion having a first end and to have a shim that extends transversely from the first end of the curved portion at a first end of the leveraging portion;

means for pivoting configured to couple the means for holding and means for leveraging; and means for gripping at a second end of the means for holding and the means for leveraging opposite the first end of the means for holding and the means for leveraging, wherein the means for receiving includes a first step, first and second windows above a receiving surface that enable viewing of placement of the clip, and a magnet and flats configured to keep the clip in place during installation.

9. The clip installing tool of claim 8, wherein the shim includes a second step configured to mate with a connector, and the curved portion is configured to clear a portion of a fuel rail.

10. The clip installing tool of claim 8, wherein the flats are in close tolerance with the clip for proper alignment of the clip with a connector of a fuel rail.

11. The clip installing tool of claim 8, wherein the magnet is flush with the receiving surface so that the clip is flatly received within the means for receiving.

12. The clip installing tool of claim 8, wherein the means for gripping are curved and include an elastomeric material.

13. The clip installing tool of claim 8, wherein the flats are configured to allow the clip to expand during installation.

14. The clip installing tool of claim 1, wherein the flats extend upwards of from the receiving surface.

15. The clip installing tool of claim 14, wherein the flats taper such that the flats are wider at the receiving surface.

16. The clip installing tool of claim 1, wherein the first end of the curved portion does not overlap with the first and second windows.

* * * * *